US012279737B2

(12) United States Patent
Boyer et al.

(10) Patent No.: US 12,279,737 B2
(45) Date of Patent: Apr. 22, 2025

(54) WALL MOUNTED DISHWASHER

(71) Applicant: Midea Group Co., Ltd., Foshan (CN)

(72) Inventors: Joel Boyer, Louisville, KY (US); Robert M. Digman, Goshen, KY (US); Bassam Fawaz, Louisville, KY (US); Russell Dietrich, Mount Washington, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 0 days.

(21) Appl. No.: 18/585,300

(22) Filed: Feb. 23, 2024

(65) Prior Publication Data

US 2024/0188789 A1 Jun. 13, 2024

Related U.S. Application Data

(62) Division of application No. 17/704,745, filed on Mar. 25, 2022, now Pat. No. 11,944,255.

(51) Int. Cl.

| | |
|---|---|
| ***A47L 15/00*** | (2006.01) |
| ***A47L 15/16*** | (2006.01) |
| ***A47L 15/22*** | (2006.01) |
| ***A47L 15/42*** | (2006.01) |

(Continued)

(52) U.S. Cl.

CPC ..... *A47L 15/50* (2013.01); *A47L 15/0089* (2013.01); *A47L 15/16* (2013.01); *A47L 15/22* (2013.01); *A47L 15/4225* (2013.01); *A47L 15/4248* (2013.01); *A47L 15/4261* (2013.01); *A47L 15/4265* (2013.01); *A47L 15/4276* (2013.01); *A47L 15/4287* (2013.01); *A47L 15/46* (2013.01); *A47L 2401/34* (2013.01)

(58) Field of Classification Search

None

See application file for complete search history.

(56) References Cited

U.S. PATENT DOCUMENTS

| | | | | |
|---|---|---|---|---|
| 2,790,451 | A | 4/1957 | Rumbaugh | |
| 3,903,911 | A * | 9/1975 | Guth | A47L 15/16 134/148 |
| 2006/0237051 | A1 | 10/2006 | Bengston | |

(Continued)

FOREIGN PATENT DOCUMENTS

| | | | |
|---|---|---|---|
| CN | 109222814 | A | 1/2019 |
| DE | 102012100671 | A1 | 8/2013 |

(Continued)

OTHER PUBLICATIONS

Nazarali, Rose, Electrolux Bifoliate Double Dishwasher Store & Cleans, TrendHunter, Retrieved from: https://www.trendhunter.com/trends/electrolux-bifoliate-double-dishwasher, 6 pages, Aug. 13, 2009.

(Continued)

*Primary Examiner* — Levon J Shahinian

(74) *Attorney, Agent, or Firm* — Gray Ice Higdon

(57) ABSTRACT

A wall mounted dishwasher incorporates storage into an exterior door of the dishwasher to facilitate user access to utensils stored in the dishwasher. The exterior door may be hinged and configured to rotate about a substantially vertical axis, and one or more spray devices and/or one or more fluid collection pans may be integrated into the exterior door.

19 Claims, 6 Drawing Sheets

(51) Int. Cl.
*A47L 15/46* (2006.01)
*A47L 15/50* (2006.01)

(56) References Cited

U.S. PATENT DOCUMENTS

| | | | |
|---|---|---|---|
| 2012/0138092 | A1 | 6/2012 | Ashrafzadeh et al. |
| 2023/0301486 | A1 | 9/2023 | Boyer et al. |

FOREIGN PATENT DOCUMENTS

| | | | |
|---|---|---|---|
| EP | 0573243 | B1 | 12/1993 |
| EP | 2557982 | B1 | 2/2013 |
| WO | 2009127926 | A1 | 10/2009 |
| WO | 2010066930 | A1 | 6/2010 |
| WO | 2011128804 | A1 | 10/2011 |

OTHER PUBLICATIONS

Freed, Stacey, Innovative Wall Mounted Dishwasher, Remodeling, Retrieved from: https://www.remodeling.hw.net/products/innovative-wall-mounted-dishwasher, 3 pages, dated Sep. 19, 2012.
Craziest Gadgets, Horizontally Wall Mounted Dishwasher Concept, Marie-Christine Lacasse & Marie Claude Savard, Retrieved from: http://craziestgadgets.com/2008/04/30/horizontally-wall-mounted-dishwasher-concept/, 7 pages, Retrieved on Nov. 22, 2021.
Appliancist, Wall Mounted Dishwasher from Siemens, Siemens, Retrieved from: https://appliancist.com/washing/dishwashers/wall-mounted-dishwasher-siemens-speedmatic.html, 8 pages, Retrieved on Nov. 22, 2021.

* cited by examiner

WALL MOUNTED DISHWASHER

BACKGROUND

Dishwashers are used in many single-family and multi-family residential applications to clean dishes, silverware, cutlery, cups, glasses, pots, pans, etc. (collectively referred to herein as "utensils"). While some dishwashers are designed to be free-standing appliances, most dishwashers are installed under a countertop, typically near a kitchen sink and adjacent to one or more base kitchen cabinets. Many consumers tend to store eating and drinking utensils, however, in wall mounted cabinets positioned above the countertop, so in many cases unloading a dishwasher after a wash cycle is complete involves a substantial amount of bending over to remove utensils from the dishwasher and lifting them up and placing them in wall mounted cabinets for storage.

Furthermore, particularly in space-constrained applications such as small kitchens, bars and entertainment areas, dishwashers often compete for space with cabinets and other appliances, and it can become difficult to justify the inclusion of a seldomly-used dishwasher in a design when it can mean a lack of sufficient storage space for utensils and other items that a consumer may desire to keep on hand. Similarly, dishwashers are rarely used in recreational vehicles because of the criticality of storage space.

SUMMARY

The herein-described embodiments address these and other problems associated with the art by providing a wall mounted dishwasher that incorporates storage into an exterior door of the dishwasher to facilitate user access to utensils stored in the dishwasher. In some instances, the exterior door may be hinged and configured to rotate about a substantially vertical axis, and in some instances, one or more spray devices and/or one or more fluid collection pans may be integrated into the exterior door.

Therefore, consistent with one aspect of the invention, a wall mounted dishwasher may include a wall mountable housing defining at least a portion of a wash tub, an exterior door coupled to the wall mountable housing, the exterior door movable between a closed position that restricts external access to the wash tub and an open position that provides external access to the wash tub, at least one spray device configured to spray wash fluid into the wash tub, a pump configured to supply wash fluid to the at least one spray device, a first storage element supported by the exterior door and configured to move with the exterior door, the first storage element configured to store one or more utensils during washing, and a second storage element supported within the wash tub and configured to remain within the wash tub when the exterior door is moved from the closed position to the open position, the second storage element configured to store one or more utensils during washing.

In some embodiments, the exterior door is a hinged door rotatably coupled to the housing through one or more hinges. Also, in some embodiments, the exterior door is configured to rotate about a substantially vertical axis. Further, in some embodiments, the first and second storage elements are disposed at a similar elevation and oppose one another when the exterior door is in the closed position. In some embodiments, the first storage element includes a sidewall configured to face the second storage element when the exterior door is in the closed position to additionally operate as a sidewall for the second storage element during washing. In addition, in some embodiments, the second storage element defines a shelf with an open front facing the exterior door when the exterior door is in the closed position.

In some embodiments, the at least one spray device includes a first spray device supported on the exterior door. In addition, in some embodiments, the exterior door is a hinged door rotatably coupled to the housing through at least one hinge, the at least one hinge includes a first hinge, and the wall mounted dishwasher further includes a supply line extending through the first hinge and in fluid communication between the pump and the first spray device to supply wash fluid from the pump to the first spray device. In addition, some embodiments may further include a docking arrangement in fluid communication with the first spray device, the docking arrangement including first and second docking members configured to dock with one another when the exterior door is in the closed position to place the first spray device in fluid communication with the pump when the exterior door is in the closed position, and to separate from one another when the exterior door is moved from the closed position.

In some embodiments, the exterior door includes a fluid collection pan disposed below the first storage element. Moreover, in some embodiments, the exterior door is a hinged door rotatably coupled to the housing through at least one hinge, the at least one hinge includes a first hinge, and the wall mounted dishwasher further includes a drain line extending through the first hinge and in fluid communication with the fluid collection pan. Some embodiments may also include a docking arrangement in fluid communication with the fluid collection pan, the docking arrangement including first and second docking members configured to dock with one another when the exterior door is in the closed position and to separate from one another when the exterior door is moved from the closed position.

In some embodiments, the housing is sized and configured to mount on a kitchen wall adjacent one or more wall cabinets. In addition, some embodiments may also include an exterior panel mounted on an exterior surface of the exterior door to mimic a wall cabinet door. In some embodiments, the housing is sized and configured to mount in a boat or recreational vehicle.

Some embodiments may further include a controller configured to operate the pump when performing a wash cycle. In addition, some embodiments may further include a storage element detector configured to detect a storage element type for at least one of the first and second storage elements, and the controller is configured to control at least one operational parameter of a wash cycle based upon the detected storage element type of the at least one of the first and second storage elements.

In some embodiments, the wash tub is a first wash tub, the exterior door is a first exterior door that controls external access to the first wash tub, and the wall mounted dishwasher includes a second wash tub and a second exterior door that controls external access to the second wash tub. In addition, in some embodiments, the controller is configured to perform separate wash cycles in the first and second wash tubs.

Also, in some embodiments, the controller is further configured to activate a beverage container warming system to warm beverage containers stored in the wash tub. Moreover, in some embodiments, the controller is further configured to activate a fan to maintain freshness of utensils stored in one or both of the first and second storage elements during long term storage.

Further, in some embodiments, the wall mountable housing includes a storage compartment configured to store one or more utensils, and the exterior door further controls external access to the storage compartment.

Consistent with another aspect of the invention, a dishwasher may include a housing defining at least a portion of a wash tub and including a side-facing opening, an exterior door coupled to the housing, the exterior door movable between a closed position that restricts external access to the wash tub through the side-facing opening and an open position that provides external access to the wash tub through the side-facing opening, a storage element supported by the exterior door and configured to move with the exterior door, the storage element configured to store one or more utensils during washing, and at least one spray device supported by the exterior door and configured to move with the exterior door, the at least one spray device configured to spray wash fluid into the wash tub and supported by the exterior door.

Consistent with another aspect of the invention, a wall mounted dishwasher may include a wall mountable housing, a hinged exterior door pivotably coupled to the wall mountable housing, the hinged exterior door pivotable about a substantially vertical axis between closed and opened positions, a storage element supported by the exterior door and configured to move with the exterior door, the storage element configured to store one or more utensils during washing, a fluid collection pan supported by the exterior door and disposed below the storage element, the fluid collection pan configured to collect fluid that drips from the storage element and the one or more utensils.

Other embodiments may include various methods for making and/or using any of the aforementioned constructions.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
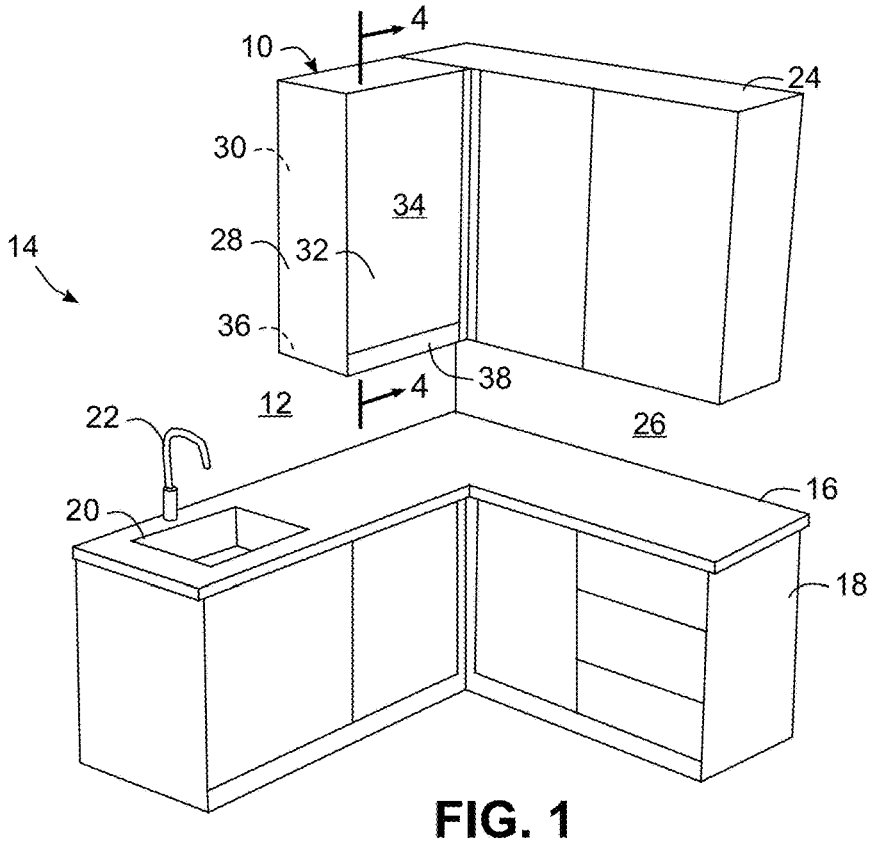
FIG. 1 is a perspective view of a room incorporating a wall mounted dishwasher consistent with some embodiments of the invention.

Turning now to the drawings, wherein like numbers denote like parts throughout the several views, FIGS. 1-4 illustrate an example wall mount dishwasher 10 in which the various technologies and techniques described herein may be implemented. As shown in FIG. 1, dishwasher 10 may be mounted on a wall 12 of a room 14, which in the illustrated embodiment may be a kitchen, bar, entertainment area, office area, retail establishment or any other residential or commercial space within which it may be desirable to include a dishwasher. In some embodiments, room 14 may even be disposed within a boat or recreational vehicle.

While not required by the invention, dishwasher 10 may be positioned above counter height, e.g., above a countertop 16 supported by a plurality of base cabinets 18, and in some instances, positioned proximate a sink 20 supplied with water by a faucet 22. In the United States, for example, the countertop may be at a height of approximately 36 inches, although other countertop heights may be used. In some instances, dishwasher 10 may have a height and elevational placement compatible with other wall mounted cabinets in room 14, e.g., wall mount cabinets 24 shown on an adjacent wall 26. In other embodiments, dishwasher 10 may not be positioned over a countertop, and may instead be integrated into a tall cabinet system.

Dishwasher 10 a residential-type built-in dishwasher, and includes a wall mountable housing 28 defining at least a portion of a wash tub 30 having a side-facing opening, along with an exterior door 32 coupled thereto and movable between a closed position (FIG. 1) that restricts external access to wash tub 30 and an open position (FIG. 3) that provides external access to the wash tub. Wall mountable housing 28 is sized and configured to be supported directly and/or indirectly at least in part by a wall (i.e., such that at least a portion of the load of the dishwasher is borne by the wall), and may be secured to wall 12 in a number of manners, e.g., via fasteners, brackets, or in various manners used for supporting wall cabinets on a wall. Moreover, housing 28 and/or exterior door 32 may include one or more exterior panels suitable for matching the surrounding wall cabinets, e.g., exterior panel 34 mounted on an exterior surface of exterior door 32, which effectively mimics a wall cabinet door. Various mechanical and electro-mechanical components for operating the dishwasher, e.g., pumps, valves, tubing, filters, etc., may be disposed in a lower portion or compartment 36 of housing 28, and in some instances, one or more control panels 38 may be included to allow for user interaction with the dishwasher. It will be appreciated that in other embodiments, no attempt may be made to mimic the look and feel of the surrounding cabinets, while in other embodiments, dishwasher 10 may have an external appearance that is substantially indistinguishable from a wall cabinet, e.g., with control panel 38 hidden behind door 32.

Figure 2:
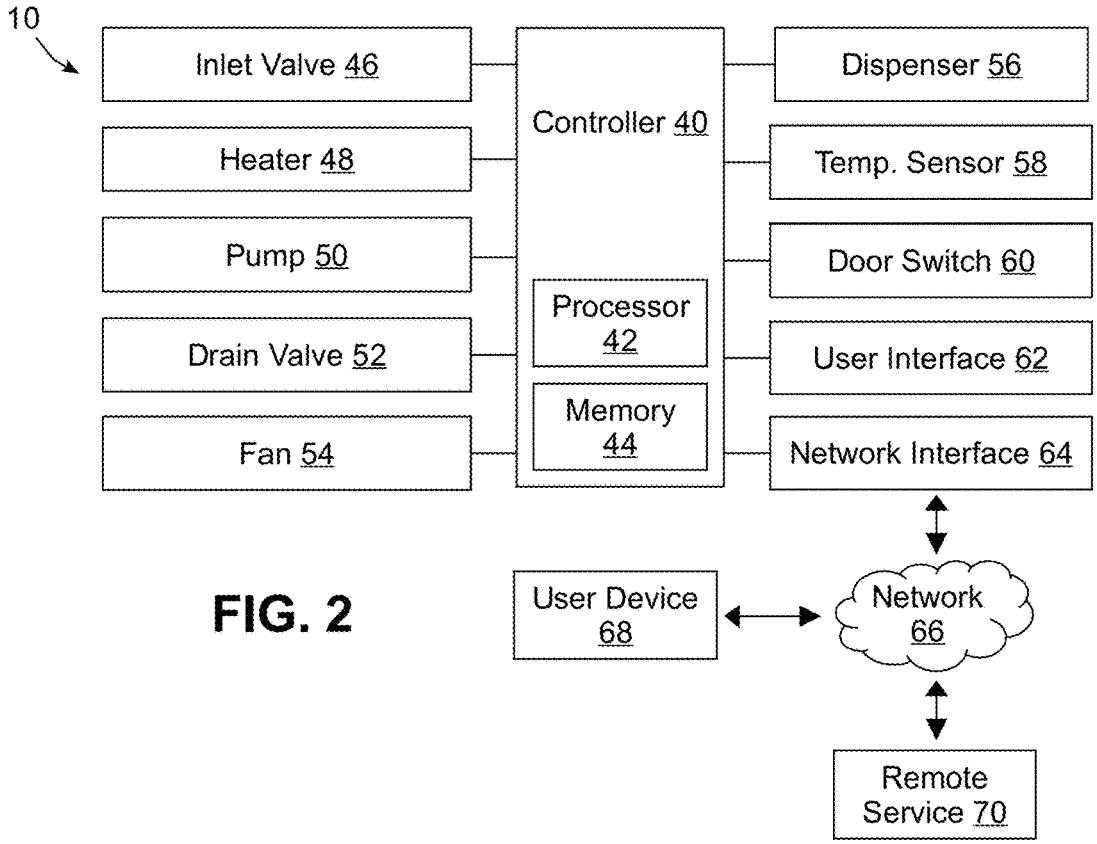
FIG. 2 is a block diagram of an example control system for the dishwasher of FIG. 1.

Now turning to FIG. 2, dishwasher 10 may be under the control of a controller 40 that receives inputs from a number of components and drives a number of components in response thereto. Controller 40 may, for example, include one or more processors 42 and a memory 44 within which may be stored program code for execution by the one or more processors. The memory may be embedded in controller 40, but may also be considered to include volatile and/or non-volatile memories, cache memories, flash memories, programmable read-only memories, read-only memories, etc., as well as memory storage physically located elsewhere from controller 40, e.g., in a mass storage device or on a remote computer interfaced with controller 40.

As shown in FIG. 2, controller 40 may be interfaced with various components, including an inlet valve 46 that is coupled to a water source to introduce water into wash tub 30, which when combined with detergent, rinse agent and/or other additives, forms various wash fluids. Controller may also be coupled to a heater 48 that heats fluids, a pump 50 that recirculates wash fluid within the wash tub by pumping fluid to the wash arms and other spray devices in the dishwasher, a drain valve 52 that is coupled to a drain to direct fluids out of the dishwasher, and a fan 54 that circulates air within wash tub 30, e.g., to accelerate drying or maintain the freshness of utensils stored in the dishwasher. In some embodiments, a single pump 50 may be used, and drain valve 52 may be configured to direct pumped fluid either to a drain or to the spray devices, such that pump 50 is used both to drain fluid from the dishwasher and to recirculate fluid throughout the dishwasher during a wash cycle. In other embodiments, separate pumps may be used for draining the dishwasher and recirculating fluid. A wash fluid may be considered to be a fluid, generally a liquid, incorporating at least water, and in some instances, additional components such as detergent, rinse aid, and other additives. During a rinse operation, for example, the wash fluid may include only water. A wash fluid may also include steam in some instances.

Controller 40 may also be coupled to a dispenser 56 to trigger the dispensing of detergent and/or rinse agent into the wash tub at appropriate points during a wash cycle. Additional sensors and actuators may also be used in some embodiments, including a temperature sensor 58 to determine a wash fluid temperature, and a door switch 60 to determine when door 32 is latched. Moreover, controller 40 may be coupled to a user interface 62 including various input/output devices such as knobs, dials, sliders, switches, buttons, lights, textual and/or graphics displays, touch screen displays, speakers, image capture devices, microphones, etc. for receiving input from and communicating with a user (e.g., at least partially disposed on control panel 38 of FIG. 1). In some embodiments, controller 40 may also be coupled to one or more network interfaces 64, e.g., for interfacing with external devices via wired and/or wireless networks 66 such as Ethernet, Bluetooth, NFC, cellular and other suitable networks. For example, dishwasher 10 may interface with one or more user devices 68, e.g., to permit consumer remote control of dishwasher 10 and/or to provide status information to a consumer. Dishwasher 10 may also interface with one or more remote services 70, e.g., for diagnostics, maintenance, system updates, remote control, and/or practically any other suitable purpose. Additional components may also be interfaced with controller 40, as will be appreciated by those of ordinary skill having the benefit of the instant disclosure.

Moreover, in some embodiments, at least a portion of controller 40 may be implemented externally from dishwasher 10, e.g., within a mobile device, a cloud computing environment, etc., such that at least a portion of the functionality described herein is implemented within the portion of the controller that is externally implemented. In some embodiments, controller 40 may operate under the control of an operating system and may execute or otherwise rely upon various computer software applications, components, programs, objects, modules, data structures, etc. In addition, controller 40 may also incorporate hardware logic to implement some or all of the functionality disclosed herein. Further, in some embodiments, the sequences of operations performed by controller 40 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Figure 3:
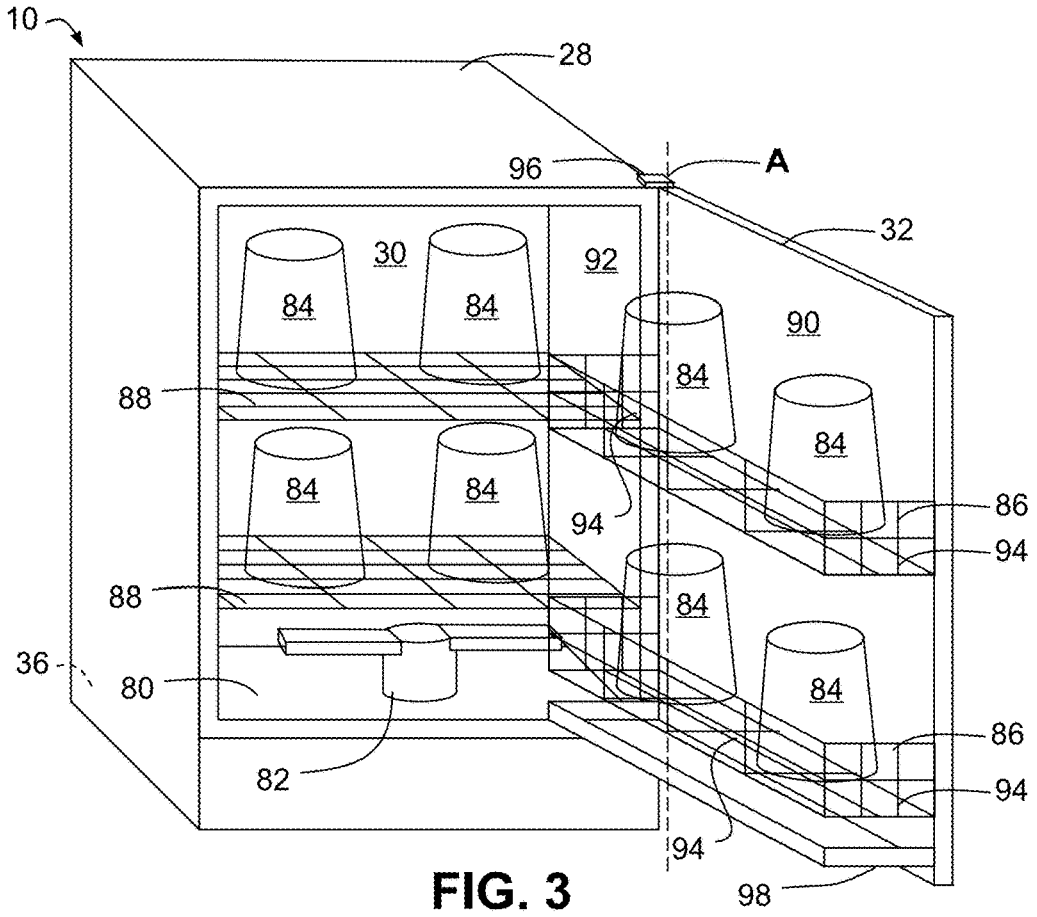
FIG. 3 is a side perspective view of the dishwasher of FIG. 1, with the exterior door shown in an open position.
Figure 4:
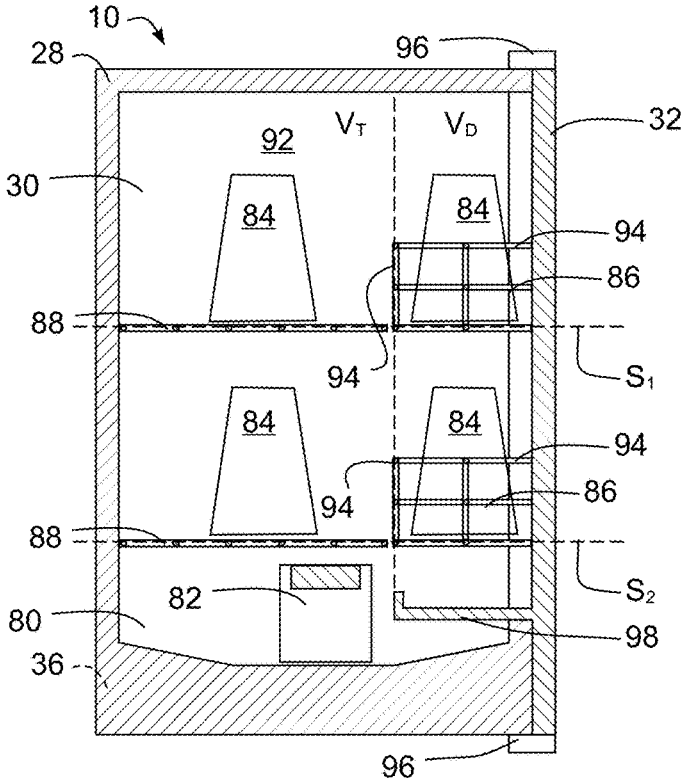
FIG. 4 is a cross-sectional view of the dishwasher of FIG. 1, taken through lines 4-4 thereof.

Now turning specifically to FIGS. 3-4, dishwasher 10 is illustrated in greater detail. It will be appreciated that the specific configuration and location of the various mechanical and electro-mechanical components discussed above in connection with FIG. 2 have been omitted from these figures, although such details would be well within the knowledge of those of ordinary skill having the benefit of the instant disclosure. In this embodiment, and similar to a standard built-in residential dishwasher, dishwasher 10 may include a sump 80 and one or more spray devices, e.g., a rotating spray arm 82, that spray wash fluid into the wash tub. Additional spray devices, e.g., additional spray arms, nozzles, sprayers, etc., whether wall or rack-mounted, may also be used in dishwasher 10 to provide sufficient washing action for cleaning utensils disposed in wash tub 30. For example, FIGS. 3 and 4 illustrate a set of glasses 84 disposed in wash tub 30, although it will be appreciated that practically any type of utensil may be placed in dishwasher 10, including cups, mugs, bottles, and other beverage containers; knives, forks, spoons, and other silverware; plates, bowls, and other dishware; pots, pans, spatulas, and other cooking utensils; etc.

In the illustrated embodiment of FIGS. 1-4, various storage elements may be disposed within wash tub 30 and used to support utensils during washing and/or storage of the utensils. FIGS. 3-4, for example, illustrate a pair of door-supported storage elements 86 and a pair of tub-supported storage elements 88 for supporting glasses 84. A storage element, in this regard, may be considered to include practically any type of structure suitable for supporting, holding, retaining, or otherwise housing a utensil during washing, and may include, for example, various types of utensil racks such as shelves, drawers or baskets, cup trees, etc., and may include various types of structures and/or geometries suitable for retaining utensils, e.g., tines, clips, stem holders, stabilizers, removable baskets or other containers, or any other configurations used in dishwashers to retain utensils during washing. Storage elements in some embodiments may be disposed at fixed locations, while in other embodiments, the storage elements may be movable, e.g., pivotable and/or slidable along rails in some embodiments, and removable in some embodiments.

A door-supported storage element 86, within the context of the invention, may include any storage element that is at least in part supported by exterior door 32 (e.g., on an inner surface 90 thereof) and is configured to move with the exterior door when the exterior door is opened. A tub-supported storage element 88, in contrast, is supported within wash tub 30, either by one or more walls 92 of the wash tub (e.g., side and/or rear walls thereof) or by another structure supported by the wash tub, and is configured to remain within the wash tub when exterior door 32 is moved from the closed position to the open position.

In the illustrated embodiment of FIGS. 1-4, when door 32 is closed, each door-supported storage element 86 extends rearwardly from the front of wash tub 30 for a portion of the depth of the wash tub such that the door-supported storage elements 86 collectively occupy a portion VD of the internal volume of wash tub 30, and each tub-supported storage element 88 extends forward from the rear of the wash tub only a portion of the depth of the wash tub such that the tub-supported storage elements 88 collectively occupy a portion VT of the internal volume of wash tub 30. Moreover, each door-supported storage element 86 is disposed at a similar elevation as a complementary tub-supported storage element 88 such that the door-supported storage elements 86 oppose the tub-supported storage elements 88 and define supporting surfaces (e.g., surfaces $S_1$, $S_2$ of FIG. 4) that are substantially continuous when door 32 is closed. Furthermore, each door-supported storage element 86 may include one or more sidewalls 94 that serve to restrict movement of utensils when door 32 is opened and closed. At least one of sidewalls 94 may face the rear of wash tub 30 when door 32 is closed, and thus face the complementary tub-supported storage element 88 such that the sidewall 94 effectively operates as a sidewall for the tub-supported storage element 88 during washing, as well as a divider between the two storage elements 86, 88. By doing so, each tub-supported storage element 88 may be configured effectively as a shelf with an open front facing door 32 when door 32 is closed, such that when door 32 is in the open position of FIG. 3, insertion and removal of utensils into and from wash tub 30 is greatly facilitated. Considering, in particular, the fact that dishwasher 10 may be mounted at a height that may be somewhat difficult for some users to reach, the lack of a front-facing side wall on each tub-supported storage element 88 may make it easier to place utensils in the wash tub prior to washing and to remove them after washing.

Moreover, in the illustrated embodiment of FIGS. 1-4, exterior door 32 is a hinged door that is rotatably coupled to housing 28 through one or more hinges 96. Moreover, door 32 is configured to rotate about a substantially vertical axis A (FIG. 3), similar to cabinet doors, and unlike many build-in dishwashers that open downwardly and rotate about a substantially horizontal axis. In other embodiments, however, an exterior door may rotate about a substantially horizontal axis, or may be a sliding door that moves linearly either within its plane or transverse to its plane (as will be discussed below in connection with FIG. 11). In still other embodiments, a combination of linear and rotary motion may be used for an exterior door.

It may also be desirable to incorporate into exterior door 32 a fluid collection pan 98, which is supported by door 32 and disposed underneath door-supported storage elements 86 to capture any moisture that may drip from the storage elements and/or any utensils stored therein. It will be appreciated, in particular, that as door 32 is moved to an open position, moisture could otherwise drip onto the countertop or the floor absent pan 98, so pan 98 may be used to prevent unwanted dripping from occurring. As will also become more apparent below, pan 98 may also be in fluid communication with a drain line to drain any captured moisture into sump 80.

In addition, by virtue of the use of door-supported storage elements 86, it will be appreciated placement of utensils onto such storage elements and removal of utensils from such storage elements may be facilitated by the fact that door 32 may be moved into a position that is more convenient for the user.

Figure 5:
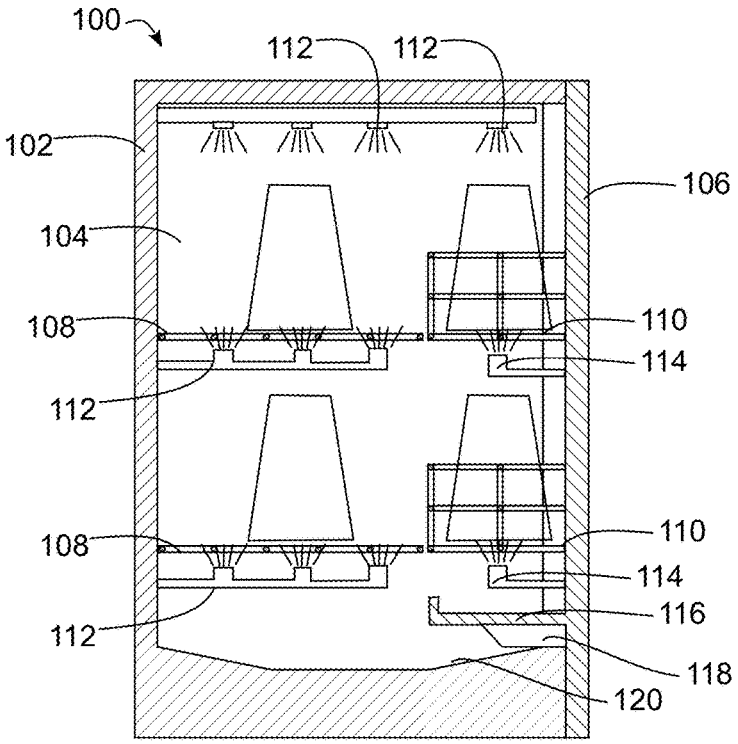
FIG. 5 is a cross-sectional view of another wall mounted dishwasher consistent with some embodiments of the invention, and including one or more door-mounted spray devices.

A number of additional features and/or alternate constructions for a wall mounted dishwasher may be used in other embodiments. FIG. 5, for example, illustrates a dishwasher 100 that is similar to dishwasher 10, but rather than utilizing only spray devices that are supported within the wash tub, dishwasher 100 includes one or more spray devices that are supported on a door. Specifically, dishwasher 100 includes a wall mountable housing 102 that houses a wash tub 104 that is accessible through an exterior door 106, and that includes both tub-supported storage elements 108 and door-supported storage elements 110 similar to the structures discussed above in connection with dishwasher 10. Dishwasher 100 also includes one or more tub-supported spray devices, e.g., arrays of nozzles 112, although a spray arm similar to spray arm 82 of dishwasher 10 may be used in some embodiments. Furthermore, dishwasher 100 includes at least one door-supported spray device, e.g., nozzles 114, supported on an interior side of door 106. A fluid collection pan 116 may also be provided in some embodiments, and in some embodiments, the fluid collection pan 116 may also include a drain 118 to assist in draining fluid collected in the pan into sump 120 of wash tub 104.

As shown in FIG. 5, nozzles 112, 114 may be positioned at various locations throughout wash tub 104 and/or on door 106 to spray utensils when supported on support elements 108, 110. Moreover, the number, direction of spray, orientation, and types of spray devices may vary in different embodiments and for different purposes. For example, if dishwasher 100 is primarily focused on washing beverage containers, it may be desirable to position some spray devices to spray upwardly into the interiors of downwardly-facing beverage containers, along with additional spray devices to spray downwardly onto the outer surfaces of the beverage containers. Various numbers and/or types of spray arms, tubular spray elements, fixed sprayers, movable sprayers, and the like may be used in different embodiments for door-supported and/or tub-supported spray devices, and it will be appreciated that door-supported spray devices may be exclusively used in some embodiments. Spray devices may also be supported at least in part on the storage elements themselves, and where the storage elements are themselves movable (e.g., if disposed on slides), various types of docking arrangements may be used to couple the spray devices to a fluid supply. Furthermore, it will be appreciated that any spray device, regardless of whether tub-supported or door-supported, may be used to spray utensils stored in tub-supported storage elements, utensils stored in door-supported storage elements, or both, in different embodiments.

Figure 6:
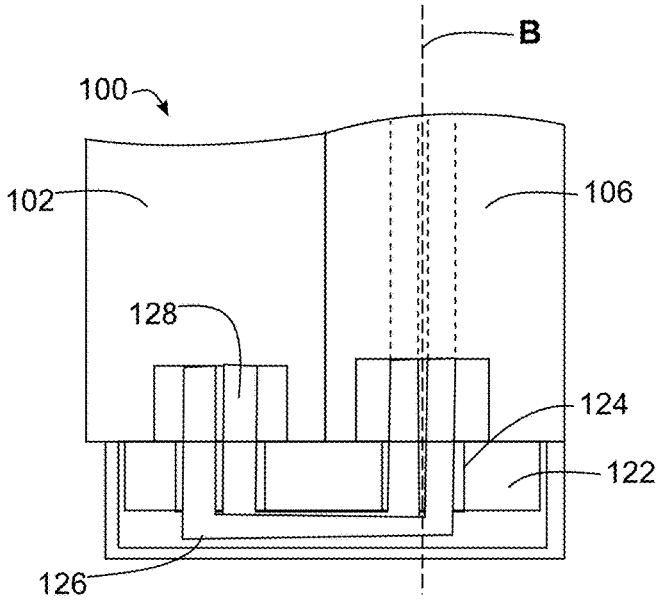
FIG. 6 is a partial cross-sectional view of a hinge suitable for routing one and/or both of a supply line and a drain line between the housing and the exterior door of the dishwasher of FIG. 5.

It will also be appreciated that in some embodiments, it may also be desirable to provide a manner of communicating wash fluid to a door-supported spray device such as a nozzle 114 and/or of communicating fluid collected in pan 116 back to sump 120, and to do so in a manner that accommodates the movable nature of door 106. FIG. 6, for example, illustrates a hinge 122 that includes a passageway 124 through which may pass a supply line 126 that fluidly couples one or more nozzles 114 with the pump and a drain line 128 that fluidly couples fluid collection pan 116 with sump 120. Hinge 122 permits rotation of door 106 about an axis B and may be configured, for example, similarly to various types of hinges that are used in refrigerators with door-mounted water and/or ice dispensers.

Figure 7:
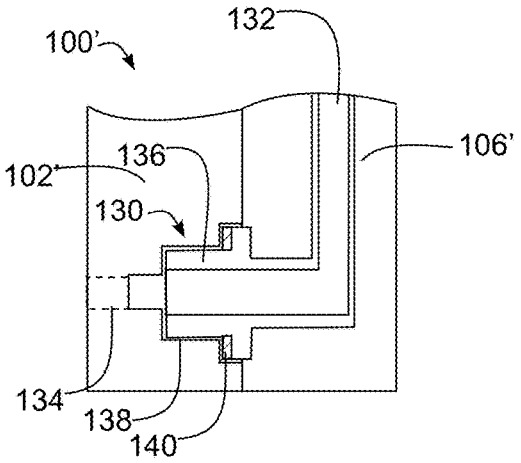
FIG. 7 is a partial cross-sectional view of a docking arrangement suitable for routing one and/or both of a supply line and a drain line between the housing and the exterior door of the dishwasher of FIG. 5.

Alternatively, as illustrated by dishwasher 100' of FIG. 7, one or both of a supply line and a drain line may instead utilize a docking arrangement 130 to fluidly couple a door-supported conduit 132 in door 106' with a housing-supported conduit 134 in housing 102'. Docking arrangement 130, for example, may utilize a pair of docking members 136, 138 to dock with one another when door 106' is in a closed position, and then separate from one another when door 106' is moved away from the closed position, similarly to various types of docking arrangements that are used in dishwashers to supply fluid to rack-mounted spray devices. It will be appreciated that docking arrangement 130 may be positioned proximate to a hinge, on an opposite side from a hinge, or in various other locations. Moreover, docking arrangement 130 may be well suited for use when door 106' is a slidable, rather than rotatable door. In some embodiments, it may also be desirable to provide a sealing arrangement, e.g., a gasket 140, to assist with sealing the dock when door 106' is closed.

Figure 8:
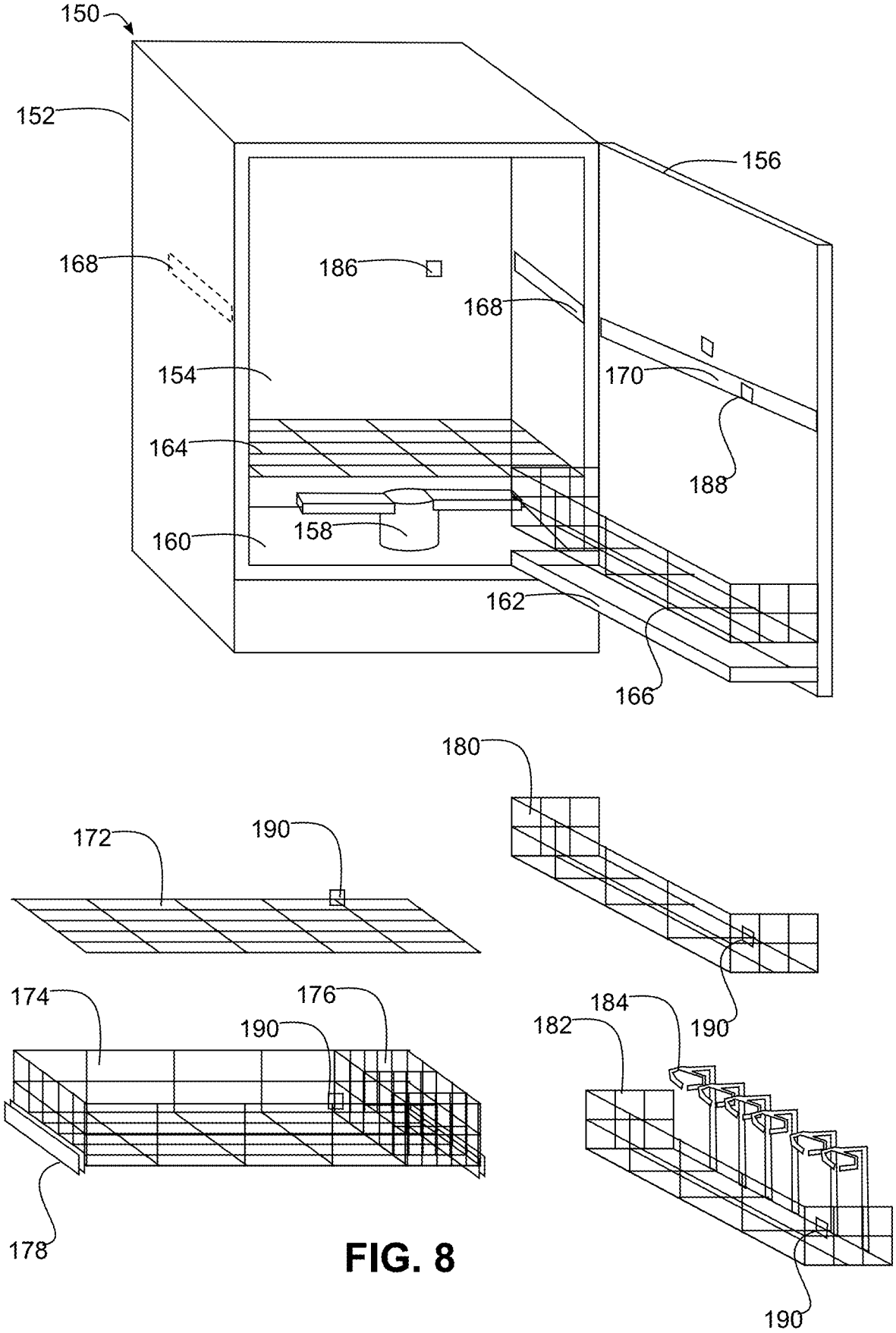
FIG. 8 is a side perspective view of another wall-mounted dishwasher, with the exterior door shown in an open position, and with various types of storage compartments suitable for being installed therein.

Now turning to FIG. 8, in some embodiments, it may be desirable to support different numbers and/or types of storage elements, e.g., storage elements adapted for particular types of utensils. Moreover, in some embodiments, one or more storage element detectors may be used to detect a type of storage element installed in a dishwasher to enable a controller to adapt a wash cycle to a particular type of utensil being washed.

In particular, FIG. 8 illustrates a dishwasher 150 similar to dishwasher 10 of FIGS. 1-4, and including a housing 152 with a wash tub 154, a hinged exterior door 156, a spray device 158, a sump 160 and a fluid collection pan 162. In addition, a fixed-location tub-supported storage element 164 and door-supported storage element 166 are also shown.

In addition, dishwasher 150 includes tub mounts 168 and a door mount 170 suitable for attaching and supporting various types of storage elements. Tub mounts 168, for example, may be used to support a shelf-type tub-supported storage element 172 similar to that used in dishwashers 10 and 100 above, as well as other types of storage elements. A sliding rack-type storage element 174, including a silverware basket 176 and slides 178, is illustrated as one example, although it will be appreciated that practically any type of storage element may be supported in different embodiments. Similarly, door mount 170 may be used to support a basket-type door-supported storage element 180, as well as other types of storage elements, such as a wine glass basket 182 that includes a set of stem holders 184 for retaining wine glasses in an inverted position, or practically any other type of storage element that may be desired.

Mounts 168, 170 may incorporate various types of attachment mechanisms, such as hooks, locking tabs, snap fits, etc. Moreover, multiple mounts may be used to support different mounting locations or elevations in some embodiments.

In addition, it may be desirable to utilize storage element detectors, e.g., storage element detectors 186, 188, to detect the presence of and/or the type of storage element currently being used. Various sensing technologies may be used, e.g., RFID, mechanical switches, etc. to detect whether a storage element is mounted and/or what type of storage element is being used. For RFID, as an example, RFID tags 190 may be mounted to each storage element 172, 174, 180, 182 for sensing by detectors 186, 188.

Based upon whether a storage element is mounted at a particular location and/or the type of storage element mounted, a controller (e.g., controller 40 of FIG. 2) may control one or more operational parameters of a wash cycle, e.g., wash time, rinse time, what spray devices are activated and when, dry time, whether to run a dry cycle, or practically any type of operational parameter that may be controlled.

Figure 9:
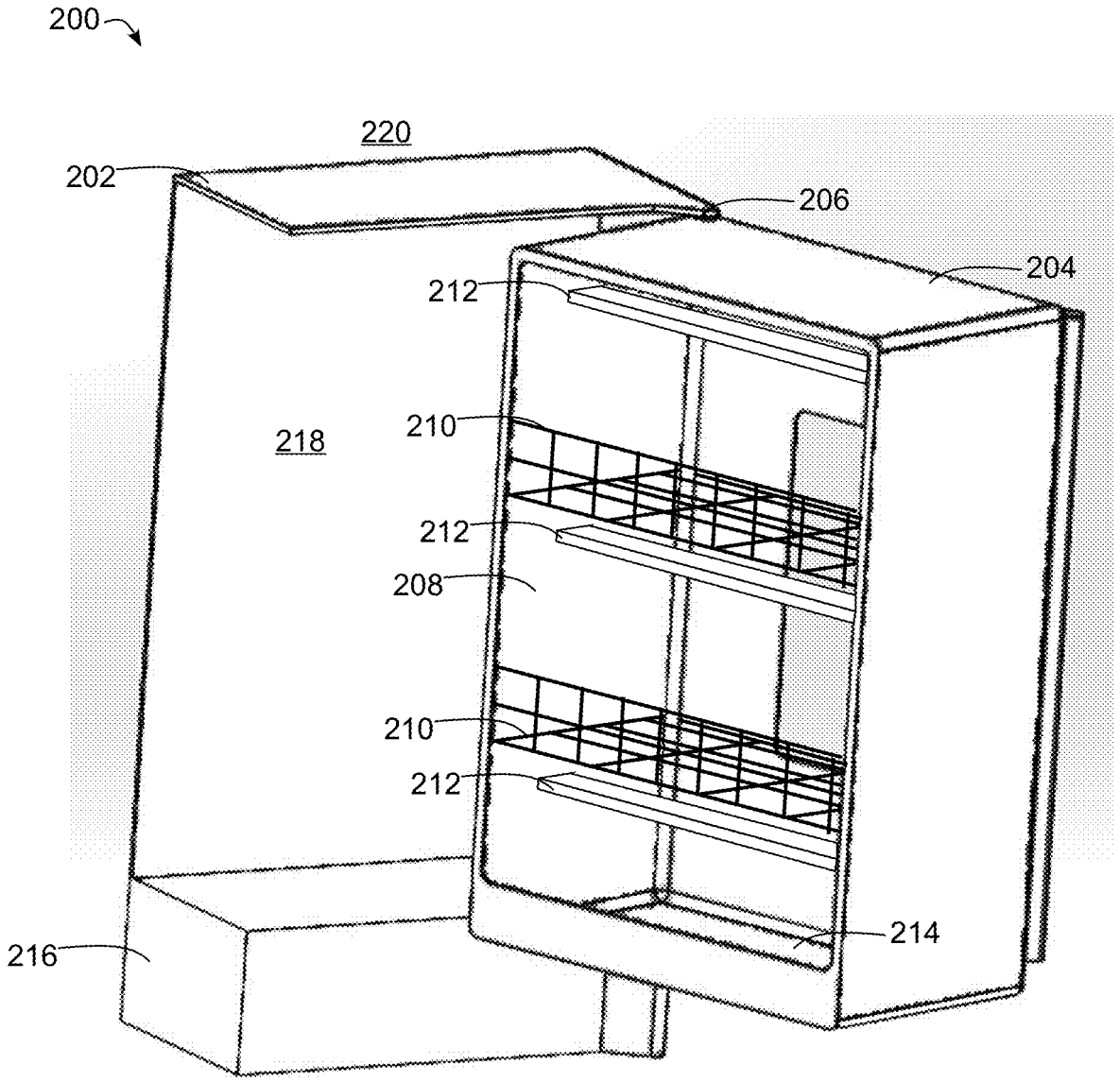
FIG. 9 is a side perspective view of another wall-mounted dishwasher, with the exterior door shown in an open position, and suitable for installation in a recreational vehicle.

Next turning to FIG. 9, in some embodiments a wall mounted dishwasher may incorporate an entire wash tub within an exterior door. Dishwasher 200, in particular, includes a wall mountable housing 202 and an exterior door 204 that is rotatably coupled to the housing through one or more hinges 206. A wash tub 208 is defined within door 204, and includes one or more door-supported storage elements 210 and one or more spray devices 212. In addition, a fluid collection pan 214 is disposed underneath storage elements 210. A mechanical station 216 may be provided on housing 202 in order to house mechanical and electro-mechanical components such as pumps, valves, filters, etc., and supply and/or drain lines may be used to fluidly couple spray devices 212 and/or pan 214 to these components, e.g., using the various supply and drain line arrangements illustrated in FIGS. 6 and 7.

While in this embodiment, additional housing-supported storage elements and/or spray devices may be used, it may be desirable in some instances to omit such housing-supported components, and instead use a back wall 218 of housing 202 to seal wash tub 208 such that all storage elements and spray devices are supported on the door. Furthermore, while mechanical station 216 in the illustrated embodiment is supported by housing 202, in other embodiments, some or all of the mechanical and/or electro-mechanical components housed in mechanical station 216 may be supported by door 204, including a configuration where all of the functional components of the dishwasher are essentially built into the door.

Housing 202 is supported on a wall 220, which in this embodiment may be the wall of a recreational vehicle or boat, or in the alternative, a commercial or residential structure, such that housing 202 is appropriately sized and configured to mount therein. In a recreational vehicle or boat, for example, housing 202 may be sized and configured to install into a wall unit along with other cabinets and/or appliances.

Figure 10:
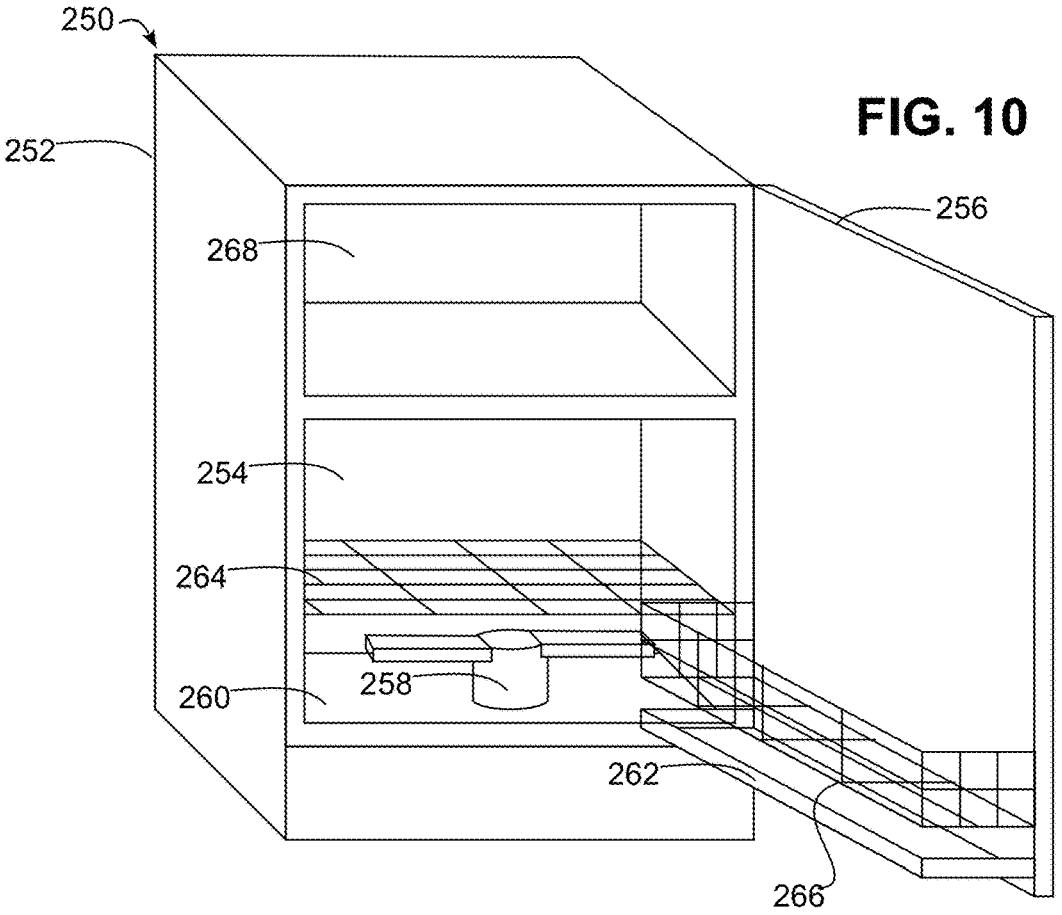
FIG. 10 is a side perspective view of another wall-mounted dishwasher, with the exterior door shown in an open position, and including multiple compartments accessed using a common exterior door.

It will be appreciated that some embodiments of the invention may also support the use of multiple wash tubs and/or storage compartments to facilitate long term storage of utensils. For example, FIG. 10 illustrates another dishwasher 250 similar to dishwasher 10 of FIGS. 1-4, and including a housing 252 with a wash tub 254, a hinged exterior door 256, a spray device 258, a sump 260 and a fluid collection pan 262. A tub-supported storage element 264 and door-supported storage element 266 are also shown.

In addition to the volume defined by wash tub 254, dishwasher 250 further includes a volume 268, which in some embodiments may be a storage compartment for longer-term storage of utensils, and in other embodiments may be a second wash tub for use in washing utensils stored therein. External access to wash tub 254 and to volume 268 is controlled by the same exterior door 256, so it will be appreciated that an exterior door in some embodiments may be capable of providing external access to multiple volumes within a dishwasher.

Various storage elements may be supported on or within wash tub 254, volume 268 or exterior door 256 for use in storing and/or washing various types of utensils. In some embodiments, for example, volume 268 may be configured as a storage compartment, with clean utensils maintained in volume 268 for long term storage and dirty utensils placed after use in wash tub 254 (or in storage element 266). After running a wash cycle, the utensils in wash tub 254 may be moved easily from wash tub 254 to volume 268.

In other embodiments, volume 268 may be configured as a second wash tub, enabling dirty utensils to be placed after use into one of the wash tubs, while clean utensils may still be accessed from the other wash tub until all of the clean utensils have been used. Once all clean utensils have been removed from the other wash tub, a wash cycle may be run to wash the dirty utensils, with the roles of the two wash tubs essentially reversed, and without requiring utensils to be removed from a wash tub after the wash cycle is complete. It will also be appreciated that, rather than having a single exterior door 256, separate exterior doors may be used to access wash tub 254 and volume 268 in some embodiments.

Figure 11:
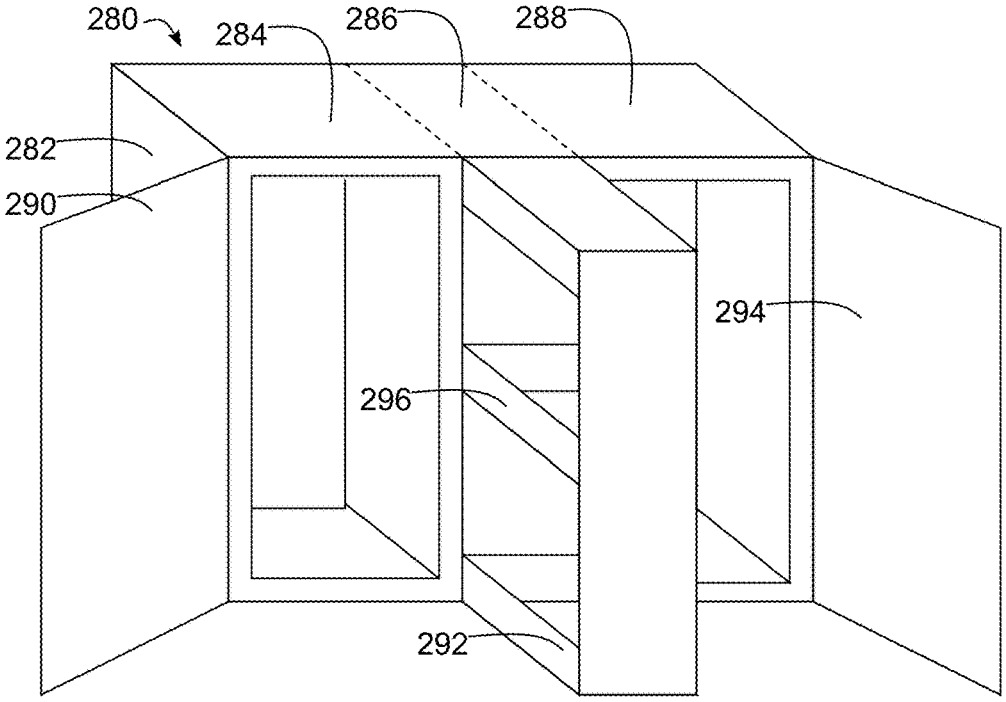
FIG. 11 is a side perspective view of another wall-mounted dishwasher, with multiple exterior doors shown in open positions, and including multiple compartments accessed thereby.

FIG. 11 illustrates another dishwasher 280 similar to dishwasher 10 of FIGS. 1-4, and including a housing 282 with three volumes 284, 286, 288, each accessed by a respective exterior door 290, 292, 294, with exterior doors 290, 294 being hinged doors that rotate about substantially vertical axes, and with exterior door 292 being a sliding door that slides open in a direction generally transverse to its plane, and that includes one or more storage elements 296 for supporting utensils, and in some instances being open on both sides to facilitate access to the utensils.

In this embodiment, any of volumes 284, 286, 288 may be configured as a wash tub and may include suitable components for washing utensils stored therein, or any of volumes 284, 286, 288 may be configured as a storage compartment used for longer term storage of utensils. Thus, it will be appreciated that different embodiments may utilize different combinations of door types, wash tubs, storage compartments and storage elements suitable for different applications. Moreover, spray devices may be supported in various volumes and/or on various exterior doors in different embodiments, and it may be desirable for any exterior doors that provide external access to a wash tub include fluid collection pans to minimize dripping from any storage elements or utensils supported by the doors.

It will be appreciated that in different embodiments, wall mounted dishwashers as described herein may be used for longer term storage of utensils, e.g., for daily use by consumers in a similar manner to a kitchen cabinet. Through placement of a wall mounted dishwasher in a location that is at eye level and/or adjacent other kitchen cabinets, a consumer may, in many instances, simply leave utensils within the dishwasher between wash cycles. In such circumstances, it may also be desirable for a wall mounted dishwasher to include functionality, e.g., as programmed into controller 40 for automatic operation and/or manual selection by a consumer, to periodically treat utensils stored in the dishwasher. For example, it may be desirable to periodically or on-demand activate fan 54 (FIG. 2) to maintain freshness of the utensils stored in a storage element in a wash tub and/or in a storage compartment. In addition, particularly for applications where the dishwasher is principally used for washing and/or storing beverage containers such as cups, mugs or glasses, it may be desirable to, at a scheduled time or on-demand, activate a beverage container warming system (e.g., heater 48) to warm beverage containers. Furthermore, in space constrained areas such as recreational vehicles and boats, the ability to store utensils between washings substantially reduces the loss of available storage that traditionally accompanies the installation of a dishwasher.

It will be appreciated that the various features discussed above in connection with different embodiments may be used together in some embodiments, so the fact that a particular feature is discussed in the context of one embodiment and is illustrated in only some figures does not mean that the feature is exclusive to that embodiment and could not be combined with features discussed in the context of other embodiments and/or figures.

Various other modifications may be made to the illustrated embodiments without departing from the spirit and scope of the invention. Therefore, the invention lies in the claims hereinafter appended.

What is claimed is:

1. A dishwasher, comprising:

a housing defining at least a portion of a wash tub and including a side-facing opening;

an exterior door coupled to the housing, the exterior door movable between a closed position that restricts external access to the wash tub through the side-facing opening and an open position that provides external access to the wash tub through the side-facing opening;

a storage element supported by the exterior door and configured to move with the exterior door, the storage element configured to store one or more utensils during washing; and at least one spray device supported by the exterior door and configured to move with the exterior door, the at least one spray device configured to spray wash fluid into the wash tub and supported by the exterior door, and the at least one spray device including an upwardly-directed spray device configured to spray into an interior of a downwardly-facing beverage container supported by the storage element.

2. The dishwasher of claim 1, wherein the housing is wall mountable.

3. The dishwasher of claim 1, further comprising a pump configured to supply wash fluid to the at least one spray device.

4. The dishwasher of claim 3, wherein the exterior door is a hinged door rotatably coupled to the housing through one or more hinges and configured to rotate about a substantially vertical axis.

5. The dishwasher of claim 4, wherein the one or more hinges includes a first hinge, and the dishwasher further comprises a supply line extending through the first hinge and in fluid communication between the pump and the at least one spray device to supply wash fluid from the pump to the at least one spray device.

6. The dishwasher of claim 3, further comprising a docking arrangement in fluid communication with the at least one spray device, the docking arrangement including first and second docking members configured to dock with one another when the exterior door is in the closed position to place the at least one spray device in fluid communication with the pump when the exterior door is in the closed position, and to separate from one another when the exterior door is moved from the closed position.

7. The dishwasher of claim 1, wherein the exterior door is substantially vertical in the open position, and wherein the exterior door includes a fluid collection pan disposed below the storage element to collect moisture that drips from the storage element when the exterior door is in the open position.

8. The dishwasher of claim 7, wherein the exterior door is a hinged door rotatably coupled to the housing through at least one hinge, wherein the at least one hinge includes a first hinge, and wherein the dishwasher further comprises a drain line extending through the first hinge and in fluid communication with the fluid collection pan.

9. The dishwasher of claim 7, further comprising a docking arrangement in fluid communication with the fluid collection pan, the docking arrangement including first and second docking members configured to dock with one another when the exterior door is in the closed position and to separate from one another when the exterior door is moved from the closed position.

10. The dishwasher of claim 1, wherein the storage element is a first storage element, the dishwasher further comprises a second storage element supported within the wash tub and configured to remain within the wash tub when the exterior door is moved from the closed position to the open position, the second storage element is configured to store one or more utensils during washing, and the first storage element includes a sidewall configured to face the second storage element when the exterior door is in the closed position to additionally operate as a sidewall for the second storage element during washing.

11. A dishwasher, comprising:

a housing defining at least a portion of a wash tub;

a hinged exterior door pivotably coupled to the housing, the hinged exterior door pivotable about a substantially vertical axis between closed and opened positions;

a storage element supported by the exterior door and configured to move with the exterior door, the storage element configured to store one or more utensils during washing; and a fluid collection pan supported by the exterior door and disposed below the storage element, the fluid collection pan configured to collect fluid that drips from the storage element and the one or more utensils when the exterior door is in both the closed position and the open position.

12. The dishwasher of claim 11, wherein the housing is wall mountable.

13. The dishwasher of claim 11, wherein the hinged exterior door is pivotably coupled to the housing through at least one hinge, wherein the at least one hinge includes a first hinge, and wherein the dishwasher further comprises a drain line extending through the first hinge and in fluid communication with the fluid collection pan.

14. The dishwasher of claim 11, further comprising a docking arrangement in fluid communication with the fluid collection pan, the docking arrangement including first and second docking members configured to dock with one another when the hinged exterior door is in the closed position and to separate from one another when the hinged exterior door is moved from the closed position.

15. The dishwasher of claim 11, further comprising at least one spray device supported by the hinged exterior door and configured to move with the hinged exterior door, the at least one spray device configured to spray wash fluid into the wash tub and supported by the hinged exterior door.

16. The dishwasher of claim 15, further comprising a pump configured to supply wash fluid to the at least one spray device.

17. The dishwasher of claim 16, wherein the hinged exterior door is pivotably coupled to the housing through at least one hinge, wherein the at least one hinge includes a first hinge, and the dishwasher further comprises a supply line extending through the first hinge and in fluid communication between the pump and the at least one spray device to supply wash fluid from the pump to the at least one spray device.

18. The dishwasher of claim 16, further comprising a docking arrangement in fluid communication with the at least one spray device, the docking arrangement including first and second docking members configured to dock with one another when the hinged exterior door is in the closed position to place the at least one spray device in fluid communication with the pump when the hinged exterior door is in the closed position, and to separate from one another when the hinged exterior door is moved from the closed position.

19. The dishwasher of claim 11, wherein the storage element is a first storage element, the dishwasher further comprises a second storage element supported within the wash tub and configured to remain within the wash tub when the hinged exterior door is moved from the closed position to the open position, the second storage element is configured to store one or more utensils during washing, and the first storage element includes a sidewall configured to face the second storage element when the hinged exterior door is in the closed position to additionally operate as a sidewall for the second storage element during washing.

* * * * *